US007597597B2

(12) United States Patent
Oishi et al.

(10) Patent No.: US 7,597,597 B2
(45) Date of Patent: Oct. 6, 2009

(54) BOAT PROPULSION UNIT

(75) Inventors: Morihiro Oishi, Shizuoka (JP); Takashi Mizokawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/203,406

(22) Filed: Sep. 3, 2008

(65) Prior Publication Data

US 2009/0075532 A1 Mar. 19, 2009

(30) Foreign Application Priority Data

Sep. 13, 2007 (JP) ..... 2007-238231

(51) Int. Cl.
*B63H 21/22* (2006.01)

(52) U.S. Cl. ..... 440/1; 440/6; 440/84

(58) Field of Classification Search ..... 440/1, 440/6, 84

See application file for complete search history.

(56) References Cited

U.S. PATENT DOCUMENTS 5,429,092 A * 7/1995 Kamei ..... 123/399
5,899,191 A * 5/1999 Rabbit et al. ..... 123/479
6,322,405 B1 * 11/2001 Griffith et al. ..... 440/6

FOREIGN PATENT DOCUMENTS

JP 3525478 B2 5/2004

* cited by examiner

*Primary Examiner*—Stephen Avila
(74) *Attorney, Agent, or Firm*—Keating & Bennett, LLP

(57) ABSTRACT

A boat propulsion unit includes an electric motor, a potentiometer arranged to detect the rotating angle of a throttle grip, a first stop mode sensor, a second stop mode sensor, and a controller including a CPU, and a disconnection and short detecting circuit. If the voltage signal fed by the disconnection and short detecting circuit is out of the specified range, the CPU detects the operation mode designated by the throttle grip based on the switching of the outputs from the first stop mode sensor and the second stop mode sensor. Then, the electric motor is driven in the forward operation mode and with the specified output power when the forward operation mode is designated, whereas, the electric motor is driven in the reverse operation mode and with the specified output power when the reverse operation mode is designated. Using this arrangement, the boat propulsion unit can obtain a minimum required boat operation as intended by the boat operator even when an abnormality has occurred in the controls.

5 Claims, 12 Drawing Sheets

BOAT PROPULSION UNIT

BACKGROUND OF THE INVENTION

1. Field of the Invention

The present invention relates to a boat propulsion unit, in particular it relates to an electric boat propulsion unit.

2. Description of the Related Art

In recent years, a boat propulsion unit for small boat applications in which an operation mode of an electric motor includes a forward operation mode, a reverse operation mode, and a stop mode, as well as the output of the electric motor is controlled by rotating a throttle grip has been disclosed. The position designated by the throttle grip is detected by using a potentiometer. Then, the controller regulates the operation mode and the output of the electric motor based on the signals received from the potentiometer.

Such a boat propulsion unit is configured to prohibit driving of the electric motor when some abnormality, such as a wire disconnection and short-circuiting has occurred on the potentiometer, regardless of the position designated by the throttle grip. This configuration is used for the sake of safety, but the consequences of its operation are very disadvantageous because the boat can no longer be propelled (controlled) by using the boat propulsion unit.

JP-A-Hei 6-249039 and JP-B-3525478 disclose a configuration in automobiles that operates such that, when an acceleration sensor cannot detect a depression amount of an accelerator pedal, engine output power is controlled based on the output of an accelerator switch which is activated and deactivated in accordance with the depression amount of the accelerator pedal.

However, the accelerator pedal according to JP-A-Hei and JP-B-3525478 is only used for designating an engine output power. JP-A-Hei 6-249039 and JP-B-3525478 do not clarify how to control an operating mode of a vehicle when the position designated by a designation device cannot be detected in an arrangement where the operating mode and the output power is designated by a rotatable designation device.

SUMMARY OF THE INVENTION

In order to overcome the problems described above, preferred embodiments of the present invention provide a boat propulsion unit in which a minimum required level of boat operation can be obtained by the boat operator, even when an abnormality has occurred in the controls.

A first preferred embodiment of the present invention provides a boat propulsion unit including an electric motor, a designation device that is rotatable and can designate by its rotation position an operating mode of the electric motor including a forward operation mode, a reverse operation mode, and a stop mode, as well as an output power of the electric motor, a first detection device arranged to detect the position designated by the designation device, a second detection device arranged to detect the operation mode of the electric motor designated by the designation device based on the rotation of the designation device, a determination device arranged to determine whether or not the first detection device can detect the position designated by the designation device, and a controller arranged to control the operating mode and the output power of the electric motor based on the determination obtained by the determination device, as well as the detection results obtained by at least one of the first detection device and the second detection device.

A second preferred embodiment of the present invention provides a boat propulsion unit in which a rotation range of the designation device includes a forward operation mode range for designating the forward operation mode, a reverse operation mode range for designating the reverse operation mode, and a stop mode range between the forward operation mode range and the reverse operation mode range used for designating the stop mode. The second detection device includes a first sensor arranged to detect the rotation of the designation device from either of the forward operation mode range and the stop mode range into the other mode range, and a second sensor arranged to detect the rotation of the designation device from either of the reverse operation mode range and the stop mode range into the other mode range.

In the boat propulsion unit in accordance with the first preferred embodiment, the controller controls the operation mode and the output power of the electric motor based on the detection results of at least the first detection device, when the determination device has determined that the first detection device can detect the position designated by the designation device. On the other hand, when the determination device has determined that the first detection device cannot detect the position designated by the designation device, the controller controls the operation mode and the output power of the electric motor based on detection results of the second detection device. In other words, when the first detection device works normally, the operation mode and the output power of the electric motor are controlled based on the detection results of at least the first detection device, whereas, when some abnormality has occurred on the first detection device, the operation mode and the output power of the electric motor are controlled based on the detection results of the second detection device. When the operation mode and the output power of the electric motor are controlled based on the detection results of the second detection device, and the second detection device detects that the forward operation mode is designated by the designation device, for example, the controller drives the electric motor in the forward operation mode and with the specified output power. Likewise, when the second detection device detects that the reverse operation mode is designated by the designation device, the controller drives the electric motor in the reverse operation mode and with the specified output power. In this way, the minimum required boat operation can be obtained as intended by the boat operator, even when some abnormality has occurred on the first detection device.

In the boat propulsion unit in accordance with the second preferred embodiment, the operation mode designated by the designation device is detected easily by using the first sensor arranged to detect the rotation of the designation device from either of the forward operation mode range and the stop mode range into the other mode range, and the second sensor arranged to detect the rotation of the designation device from either of the reverse operation mode range and the stop mode range into the other mode range.

According to the preferred embodiments of the present invention, the minimum required boat operation can be obtained as intended by the boat operator, even when some abnormality has occurred.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 9A shows the condition in which the throttle grip is rotated from the position of FIG. 5 toward the forward operation mode range. FIG. 9B shows the condition in which the throttle grip is further rotated from the position of FIG. 9A into the forward operation mode range.

FIG. 10A shows the condition in which the throttle grip is rotated from the position of FIG. 5 toward the reverse operation mode range. FIG. 10B shows the condition in which the throttle grip is further rotated from the position of FIG. 10A into the reverse operation mode range.

DETAILED DESCRIPTION OF PREFERRED EMBODIMENTS

Description will hereinafter be made of the preferred embodiments of a boat propulsion unit according to the present invention with respect to FIG. 1 through FIG. 12.

Figure 1:
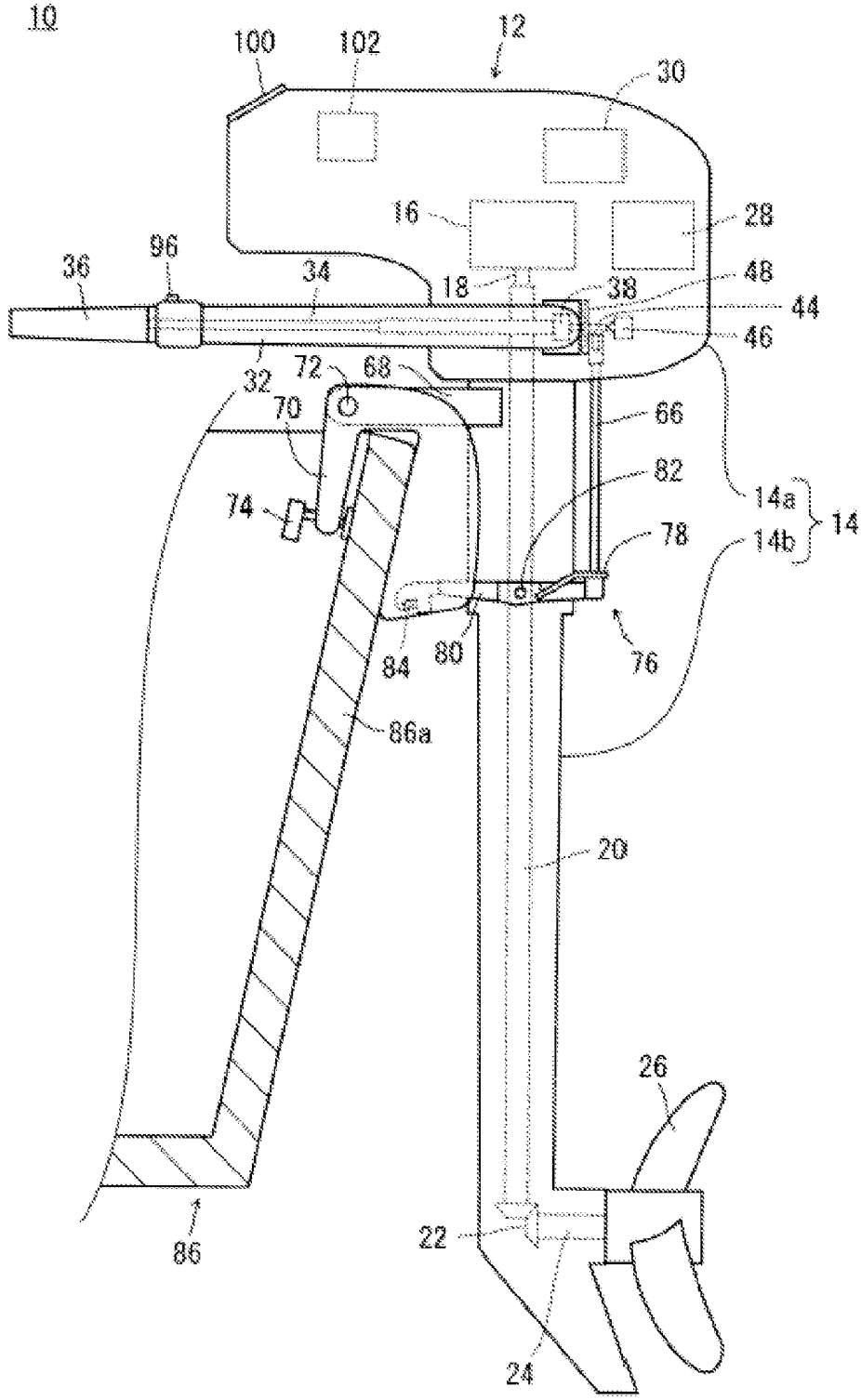
FIG. 1 is an illustration showing a boat propulsion unit according to a preferred embodiment of the present invention.

Referring to FIG. 1, a boat propulsion unit 10 according to a preferred embodiment of the present invention is an electric boat propulsion unit for small boat applications. An outboard motor may define the boat propulsion unit 10, or the boat propulsion unit 10 may be constructed as an integral portion of the boat.

The boat propulsion unit 10 has a propulsion unit body 12. The propulsion unit body 12 includes a housing 14 having an upper housing 14*a* and a lower housing 14*b*. An electric motor 16 is provided in the upper housing 14*a*. A drive shaft 20 is coupled to a rotor 18 of the electric motor 16. The electric motor 16 is, for example, a DC motor driven by the electric power from a direct-current power supply. In this preferred embodiment, the direct-current power supply is a battery 30 that will be described later. The drive shaft 20 extends from the upper housing 14*a* through the lower housing 14*b*, and is connected to a propeller shaft 24 by a bevel gear 22. A propeller 26 is connected to the end of the propeller shaft 24. The rotational direction of the propeller 26 is determined by the rotational direction of the electric motor 16.

A controller 28 and the battery 30 are provided within the upper housing 14*a*, and one end of a steering handle 32 is attached to a side surface of the upper housing 14*a*. The steering handle 32 is preferably arranged to extend generally horizontally. A hull 86, which will be described later, is steered by swinging the steering handle 32 left and right to turn the direction of the propulsion unit 10.

Figure 2:
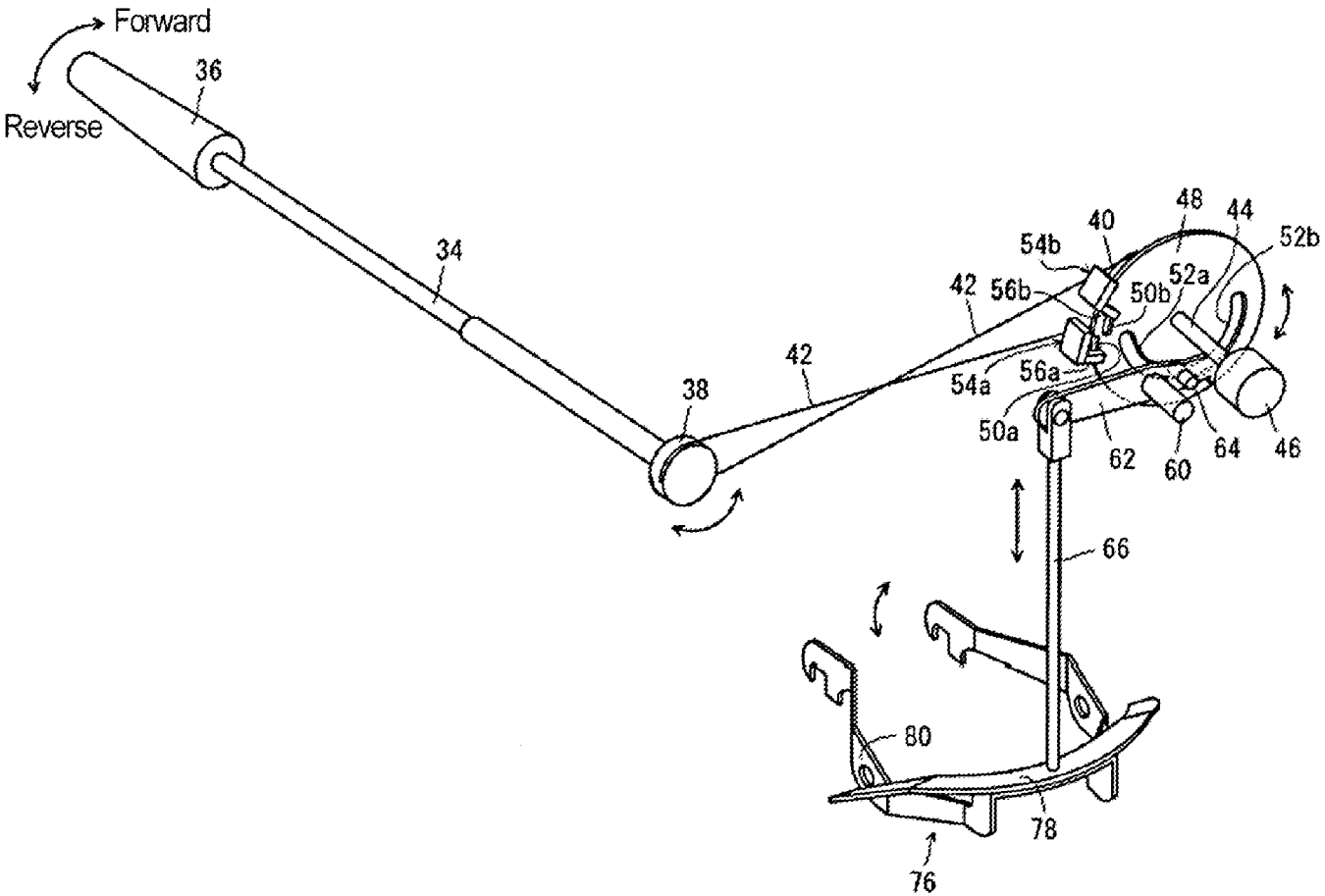
FIG. 2 is a perspective view showing the major linkage structure of the preferred embodiment according to FIG. 1.
Figure 3:
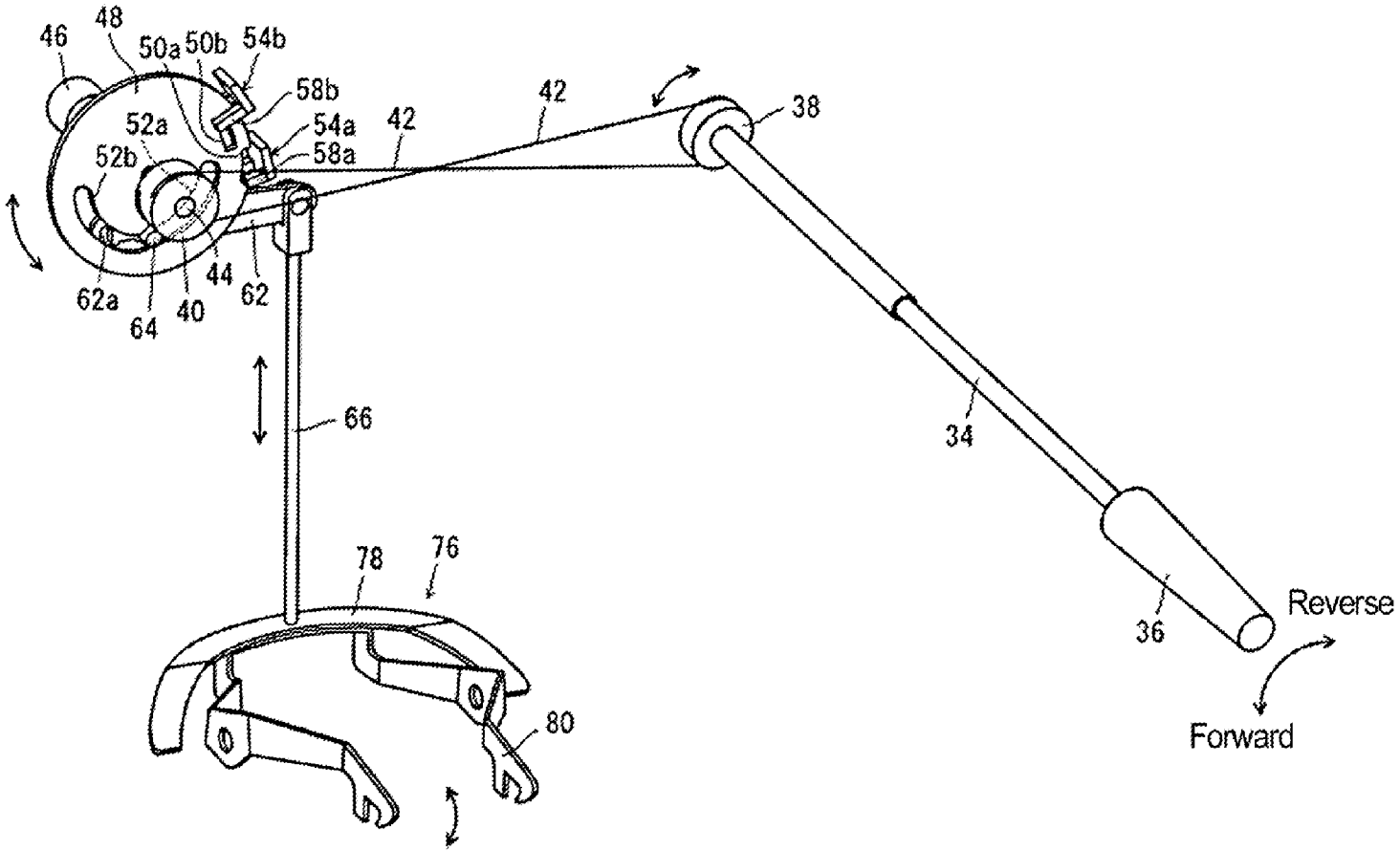
FIG. 3 is a perspective view showing the major linkage structure of the preferred embodiment according to FIG. 1.
Figure 4:
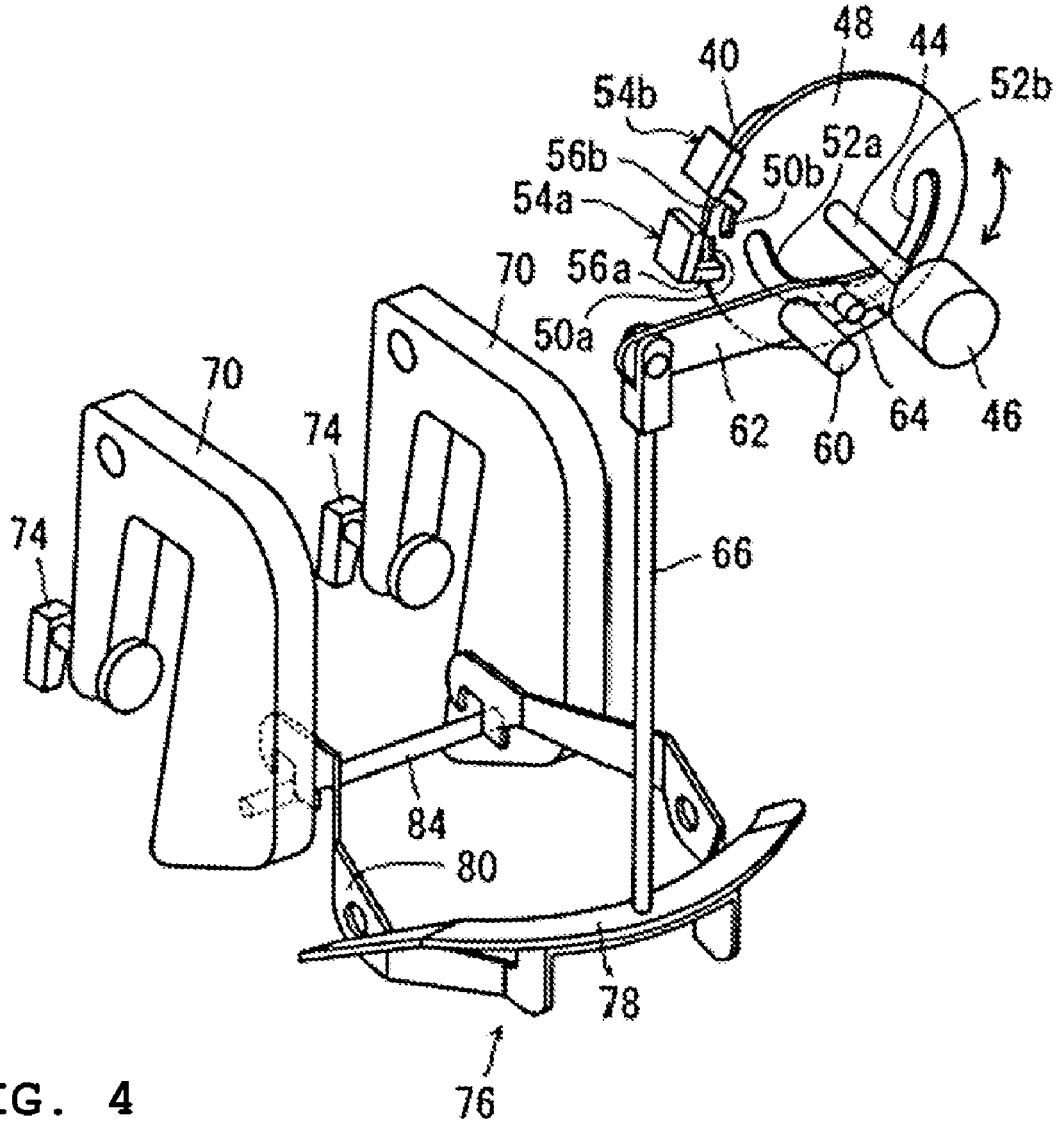
FIG. 4 is a perspective view showing the area around a pair of brackets and the stopper section.

Referring also to FIGS. 2 through 4, a transmission shaft 34 is provided within the steering handle 32 to extend along the axis of the steering handle 32. A throttle grip 36, connected to the transmission shaft 34, is provided at the other end of the steering handle 32. The operation mode and the output power of the electric motor 16 can be adjusted by rotating (turning) the throttle grip 36 about its circumferential direction.

The transmission shaft 34 has a pulley 38 attached to its end, and the pulley 38 is coupled to a pulley 40 located within the upper housing 14*a* by two cables 42. The pulley 40 rotates in synchronization with the rotation of the pulley 38.

A rotating shaft 44 is attached to the pulley 40, and a potentiometer 46 is provided at the end of the rotating shaft 44. The potentiometer 46 generates the output voltage signals within the specified range corresponding to the rotation angle (the degree of turning) of the pulleys 40 and 38 and the throttle grip 36, which in turn indicates the position of the throttle grip 36. The output of the potentiometer 46 is fed to a controller 28. In this preferred embodiment, the power supply voltage preferably is about 5V (volts), and the output voltage signals preferably ranging from about 1.3V to about 3.7V are fed to the controller 28 by the potentiometer 46, for example.

Further, a generally disc-shaped cam plate 48 is attached to the rotating shaft 44 between the pulley 40 and the potentiometer 46. The cam plate 48 rotates in synchronization with the rotation of the pulley 40.

Figure 5:
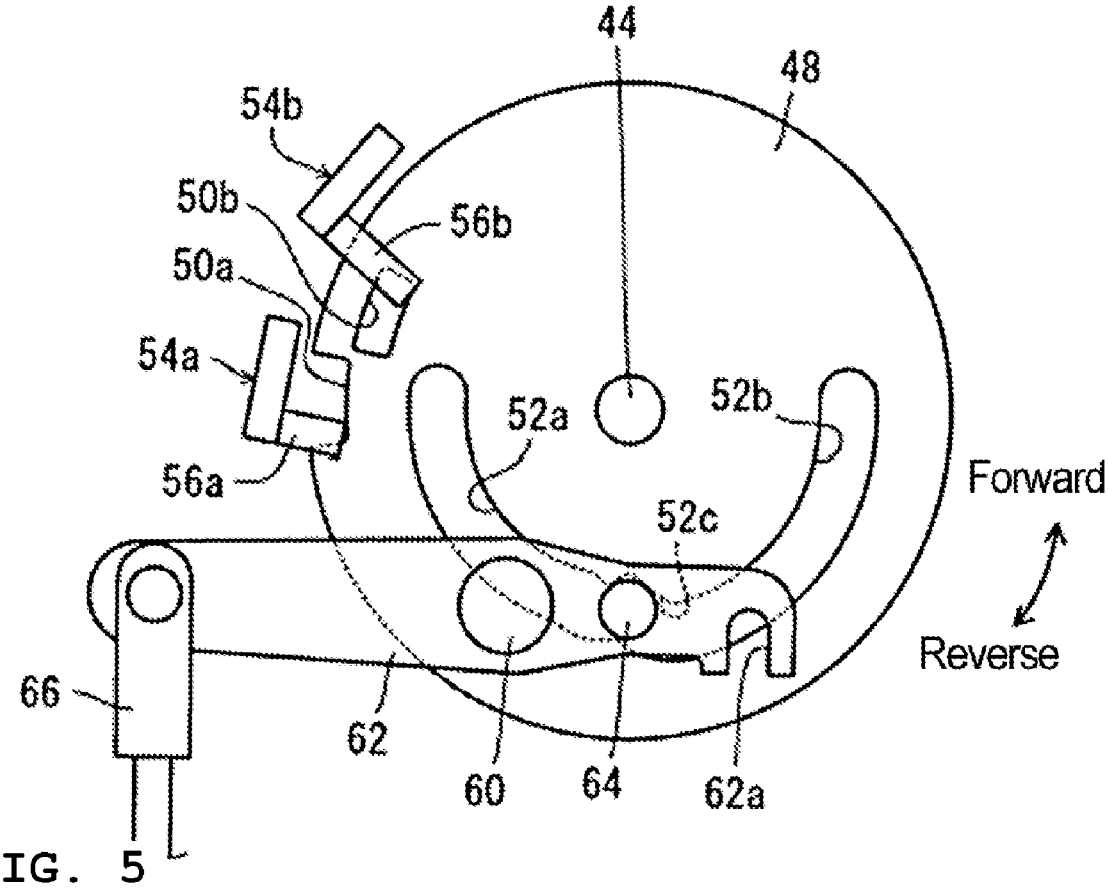
FIG. 5 is an illustration showing the relative position of the cam plate, the first stop mode sensor, and the second stop mode sensors when the neutral position is designated by the throttle grip.

Referring also to FIG. 5, a cutout 50*a* for detecting a stop mode and a slot 50*b* are formed on the cam plate 48. The cutout 50*a* is arranged on the peripheral edge of the cam plate 48. The slot 50*b* penetrates through the cam plate 48 in such position that the slot 50*b* is closer to the center of the cam plate 48 than the cutout 50*a*, and at the same time the slot 50*b* is displaced in the circumferential direction on the cam plate 48 relative to the cutout 50*a*.

In addition, continuous slots 52*a* and 52*b* penetrate through the cam plate 48, with a slot 52*c* positioned in between. The slots 52*a* and 52*c* are located closer to the center of the cam plate 48 than the slot 52*b*.

In the vicinity of the peripheral edge of the cam plate 48, a first stop mode sensor 54*a* is disposed to detect the cutout 50*a*, while a second stop mode sensor 54*b* is disposed to detect the slot 50*b*. The first stop mode sensor 54*a* includes a light emitting portion 56*a* and a light receiving portion 58*a* (see FIG. 3) opposing each other, with the cam plate 48 positioned in between. The light emitting portion 56*a* and the light receiving portion 58*a* are disposed so that the cutout 50*a* passes between them as the cam plate 48 rotates. Similarly, the second stop mode sensor 54*b* includes a light emitting portion 56*b* and a light receiving portion 58*b* (see FIG. 3) facing each other, with the cam plate 48 positioned in between. The light emitting portion 56*b* and the light receiving portion 58*b* are disposed so that the slot 50*b* passes between them as the cam plate 48 rotates.

The output of the first stop mode sensor 54*a* becomes a "HIGH" level when the cutout 50*a* comes between the light emitting portion 56*a* and the light receiving portion 58*a* to allow the light from the light emitting portion 56*a* to go through the cutout 50*a* and be received by the light receiving portion 58*a*. Whereas, the output of the first stop mode sensor 54*a* becomes a "LOW" level when the cam plate 48 comes between the light emitting portion 56*a* and the light receiving portion 58*a* to block the light from the light emitting portion 56*a* aimed at the light receiving portion 58*a*. In other words, the output of the first stop mode sensor 54*a* becomes "HIGH" when the cutout 50*a* is detected, while its output becomes "LOW" when the cutout 50*a* is not detected.

Similarly, the output of the second stop mode sensor 54*b* becomes "HIGH" when the light from the light emitting portion 56*b* passing through the slot 50*b* is received by the light receiving portion 58*b*, otherwise the output of the second stop mode sensor 54*b* is kept at the "LOW" level at all other times. Although the cutout 50*a* can also pass between the light emitting portion 56*b* and the light receiving portion 58*b* of the second stop mode sensor 54*b*, a light emitting element of the light emitting portion 56*b* and a light receiving element of the light receiving portion 58*b* are provided to detect only the slot 50*b*. Therefore, the cutout 50*a* cannot be detected by the second stop mode sensor 54*b*.

In addition, a generally strap-shaped arm section 62 supported by a support shaft 60 is provided in the vicinity of the principal surface of the cam plate 48 facing the potentiometer 46.

A collar 64 is provided on the arm section 62 in the position relatively close to its end. The collar 64 is inserted into the slots 52*a* through 52*c* on the cam plate 48.

Also, a spring member (not shown) is attached to an end portion 62*a* of the arm section 62, so that the arm section 62 is always urged upward by the tension of the spring member. This allows smooth sliding motion of the collar 64 relative to the slots 52*a* through 52*c* to allow precise movement of the collar 64 within the slots 52*a* through 52*c*. This also gives a more distinctive reaction when the collar engages with the slot 52*c* on the cam plate 48. Thus, the operator can recognize the neutral position more distinctively, resulting in an improved operating feeling. FIG. 5 shows the condition in which the collar 64 is located in the slot 52*c* as the throttle grip 36 indicates the neutral position (0 degree) in its rotation range.

Further, a rod-shaped pushing section 66 is installed at the base end of the arm section 62.

Turning to FIG. 1, a mounting section (a swivel bracket) 68 for supporting the lower housing 14*b* is provided on the upper side surfaces of the lower housing 14*b*. The mounting section 68 is connected to a pair of bracket sections (clamp brackets) 70 disposed on both sides of the mounting section 68 via a tilting shaft 72 in a manner to allow a vertical tilting motion. The bracket section 70 has a clamping portion 74. In addition, the bracket section 70 has a stopper portion (not shown) on which the mounting section 68 abuts when the propulsion unit body 12 is tilted down to the lower limit position (the condition shown in FIG. 1).

Also, in a relatively upper portion on the periphery of the lower housing 14*b*, a generally n-shaped stopper section 76 which functions with the pushing section 66, is supported in a manner so as to allow a tilting motion. Referring also to FIGS. 2 through 4, the stopper section 76 has a plate lever portion 78 curved to extend along the periphery of the lower housing 14*b* and positioned on the opposite side from the hull 86 (to be described later), and an arm portion 80 extending from the lever portion 78. The arm portion 80 is connected to the lower housing 14*b* by a support shaft 82 in a manner to allow the vertical tilting motion, and the end portion of the arm portion 80 is always urged downward by the spring member (not shown). Additionally, a receiving bar 84 is attached to the bracket section 70 to which the end portion of the arm portion 80 is engaged and locked.

Thus, the boat propulsion unit 10 is mounted to the hull 86 by attaching the bracket section 70 to a transom 86*a* of the hull 86 and tightening the clamping portion 74.

In the structure described above, the cam plate 48 makes a rotational movement according to the rotation of the throttle grip 36, which in turn makes the collar 64 slide through the slots 52*a* through 52*c* causing a vertical movement of the collar 64 due to the difference in height between the slot 52*a* and the slot 52*b*. The arm section 62 makes a swinging motion according to the vertical movement of the collar 64, which in turn causes the vertical movement of the pushing section 66 to act on the lever portion 78. For instance, when the collar 64 is in the slot 52*a* (see FIG. 9B), the pushing section 66 is lowered, and the arm portion 80 is released and disengaged from the receiving bar 84. In this way, the reverse lock is released. On the other hand, when the collar 64 is in the slot 52*b* (see FIG. 10B), the pushing section 66 is raised, and the arm portion 80 is engaged and locked with the receiving bar 84. Thus, the reverse lock is in place. Note that the collar 64 passes through the slot 52*c* when the inserting position of the collar 64 moves from the slot 52*a* to the slot 52*b* or vice versa. The switching of the reverse lock between the engagement and the release is notified to the operator by the movement going through the slot 52*c*, resulting in further improvement of controlling the boat.

Figure 6:
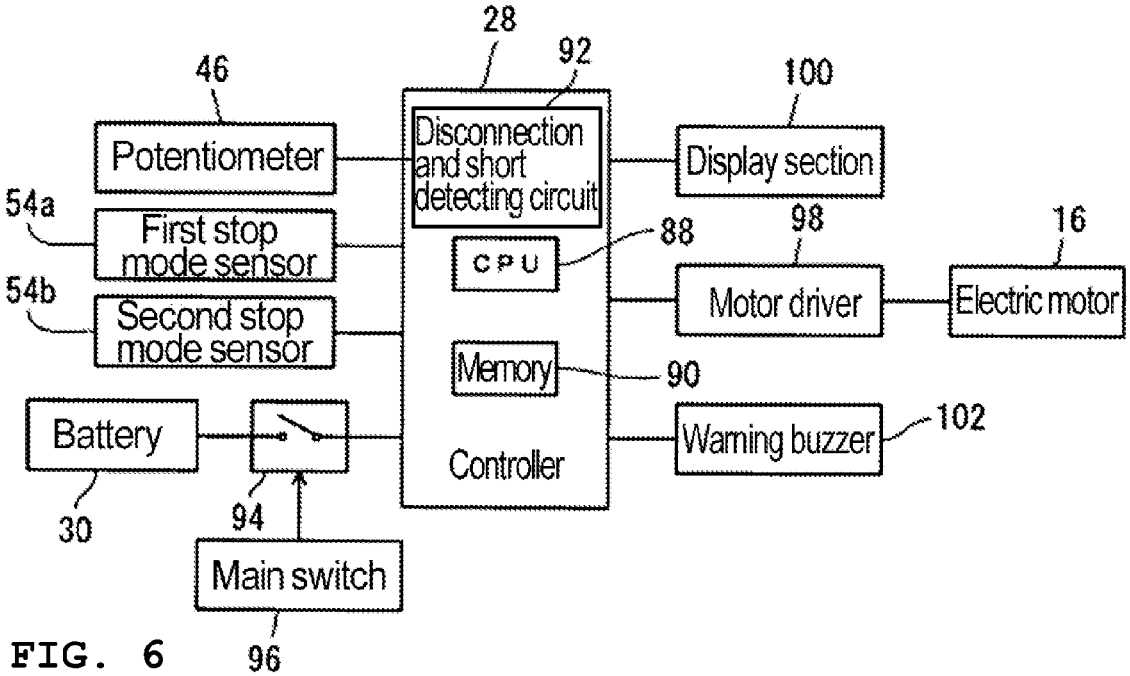
FIG. 6 is a block diagram showing an electrical structure according to a preferred embodiment of the present invention.

Next, the electrical configuration of the boat propulsion unit 10 will be described referring to FIG. 6.

The controller 28 preferably includes a CPU 88 arranged to carry out the required computations to control the operation of the boat propulsion unit 10, a memory 90 including an EEPROM, for instance, arranged to store the programs and data used for controlling the operation of the boat propulsion unit 10, as well as the computation data, and a disconnection and short detecting circuit 92 for detecting disconnection or short-circuiting of the potentiometer 46.

Outputs of the potentiometer 46, the first stop mode sensor 54*a*, and the second stop mode sensor 54*b* are respectively fed to the CPU 88 of the controller 28.

The potentiometer 46 is connected to the disconnection and short detecting circuit 92. Usually, the voltage signals within the specified range (for example, from about 1.3V to about 3.7V) are fed to the CPU 88 by the potentiometer 46 through the disconnection and short detecting circuit 92. If some abnormality including disconnection or short-circuiting has occurred on the potentiometer 46, voltage signals out of the specified range are fed to the CPU 88 through the disconnection or short detecting circuit 92.

When a disconnection of the potentiometer 46 has occurred, a voltage signal of 0V is fed to the CPU 88 through the disconnection or short detecting circuit 92. When a short-circuiting of the potentiometer 46 has occurred, a voltage signal of 5V is fed to the CPU 88 through the disconnection or short detecting circuit 92.

Once the voltage signal of 0V or 5V is fed to the CPU 88 through the disconnection or short detecting circuit 92, the CPU 88 gives an instruction to a motor driver 98 to stop the electric motor 16.

The battery 30 is also connected to the CPU 88 via a relay 94. The switching action of the relay 94 is controlled by a main switch 96. As shown in FIG. 1, the main switch 96 is provided on the steering handle 34.

The CPU 88 also controls a display section 100 on which information including those for the boat operation are indicated. Referring to FIG. 1, the display section 100 is provided on the upper housing 14*a*.

Further, the CPU 88 controls a warning buzzer 102 that notifies the boat operator of the occurrence of some abnormality. Referring to FIG. 1, the warning buzzer 102, acting as a notification, is provided within the upper housing 14*a*.

Figure 8:
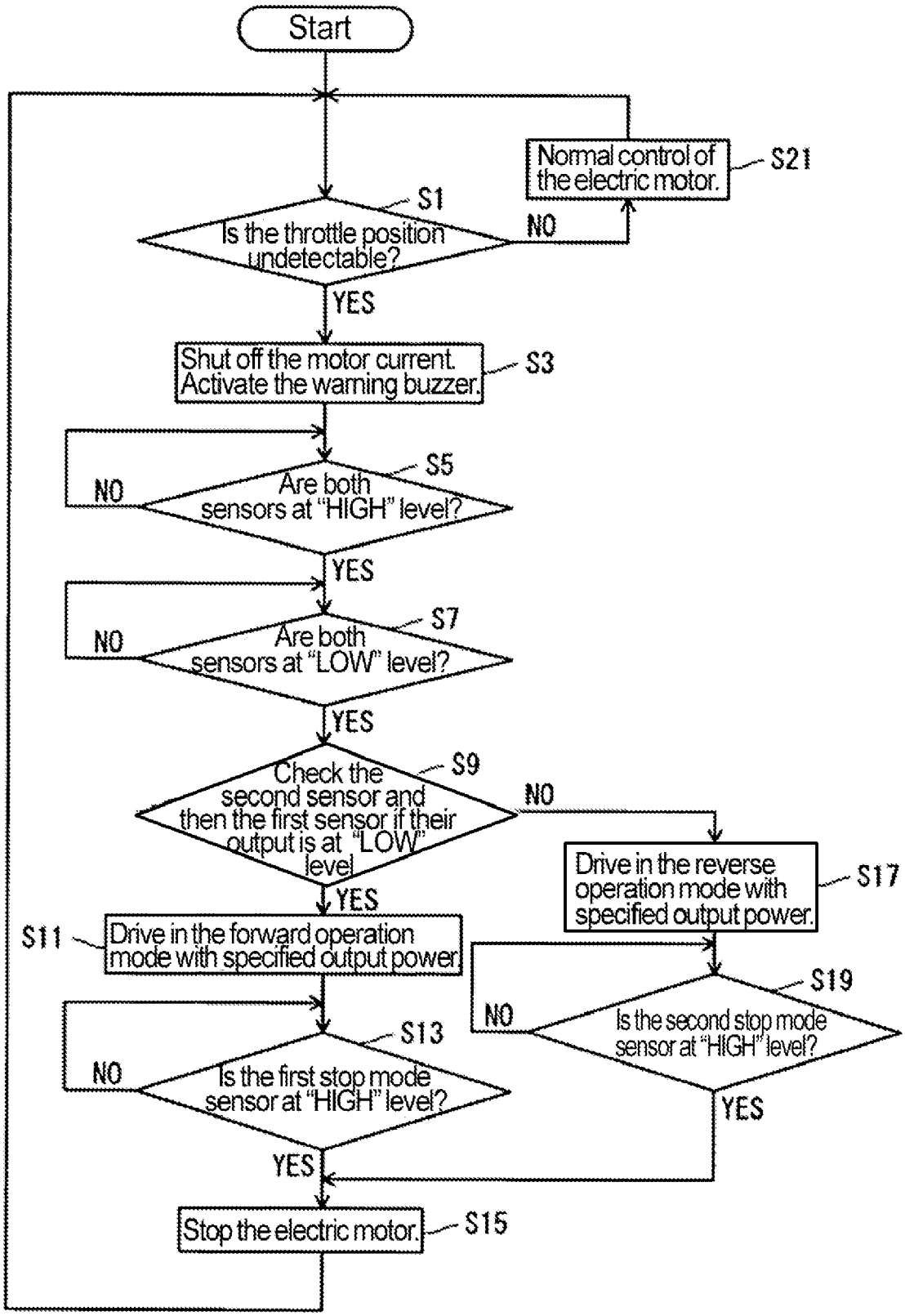
FIG. 8 is a flow chart showing an example of the operation regarding the boat propulsion unit according to a preferred embodiment of the present invention.

Programs for carrying out the operation described in FIG. 8, for instance, as well as various kinds of data are stored in the memory 90 acting as a storage device.

Figure 7:
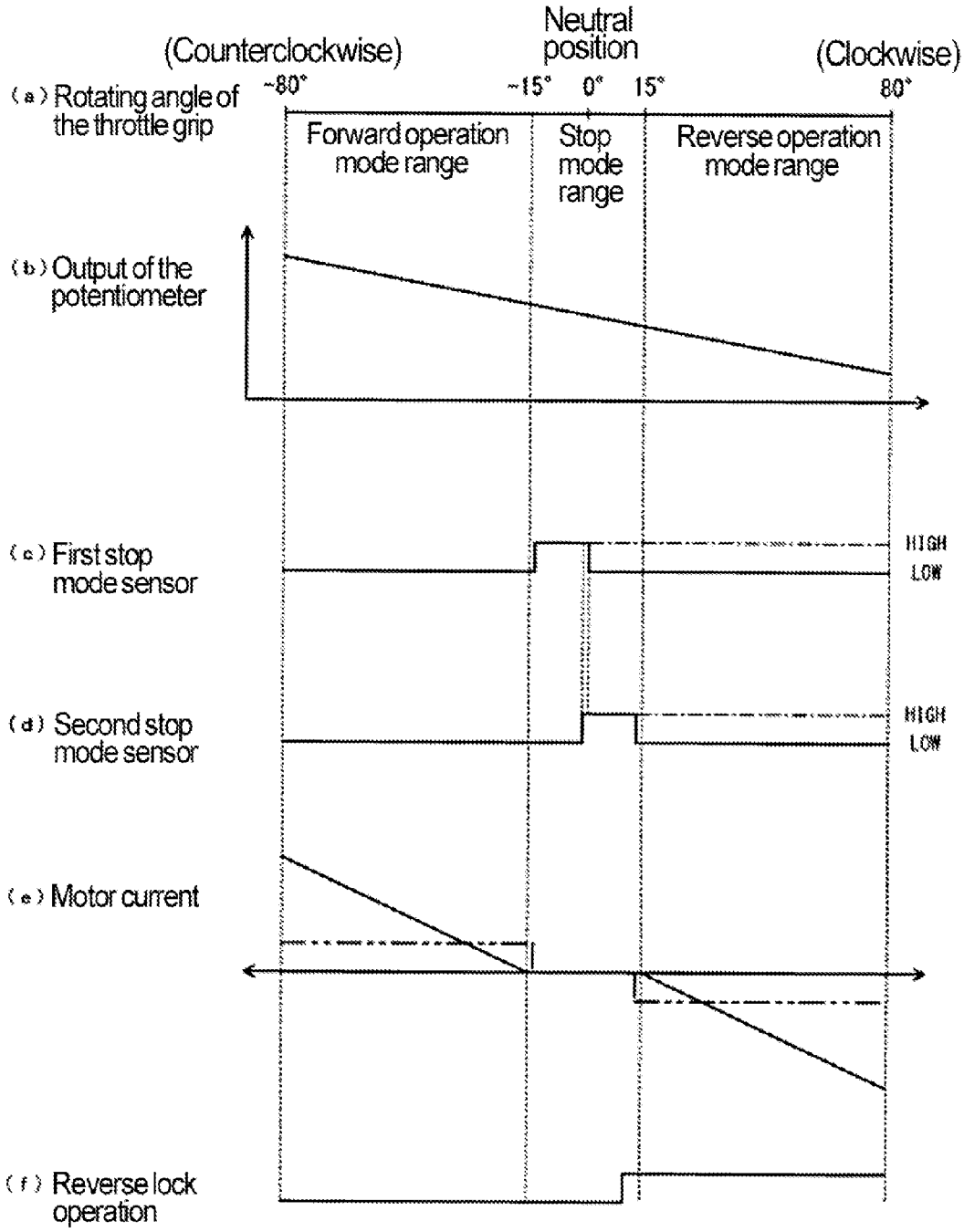
FIG. 7 is a graph showing the outputs of the relevant devices in relation to the rotation of the throttle grip.

Next, in FIG. 7 elements (a) through (f) show the output of the potentiometer 46, the output of the first stop mode sensor 54*a*, the output of the second stop mode sensor 54*b*, the electric current of the motor, and the action of the reverse lock, in response to the rotation of the throttle grip 36.

As shown by element (a) in FIG. 7, the forward operation mode is attained by rotating the throttle grip 36 counterclockwise from the stop mode condition (from the neutral condition), while the reverse operation mode is attained by rotating the throttle grip 36 clockwise. In this preferred embodiment, the throttle grip can be rotated to about +/−80 degrees at the maximum, for example. The rotating angle range within about +/−15 degrees including the neutral position is the stop mode range to designate the stop mode, the rotating angle range covering from about −15 degrees to about −80 degrees is the forward operation mode range to designate the forward operation mode, and the rotating angle range covering from about 15 degrees to about 80 degrees is the reverse operation mode range to designate the reverse operation mode, for example.

As shown by element (b) in FIG. 7, the output of the potentiometer 46 changes linearly within the specified range (e.g., from about 1.3V to about 3.7V in this example) according to the position designated by the throttle grip 36. Therefore, the rotating angle of the throttle grip 36, and also the position designated by the throttle grip 36 can be detected based on the output of the potentiometer 46.

As shown by element (c) in FIG. 7, the output of the first stop mode sensor 54*a* becomes "HIGH" from a point a little closer to the neutral position relative to the boundary of the forward operation mode range and the stop mode range, to a point a little closer to the reverse operation mode range relative to the neutral position. Specifically in this preferred embodiment, the output of the first stop mode sensor 54*a* becomes "HIGH" when the rotation angle of the throttle grip 36 falls within the range from about −14 degrees to about +1 degree.

As shown by element (d) in FIG. 7, the output of the second stop mode sensor 54*b* becomes "HIGH" from a point a little closer to the forward operation mode range relative to the neutral position, to a point a little closer to the neutral position relative to the boundary of the stop mode range and the reverse operation mode range. Specifically in this preferred embodiment, the output of the second stop mode sensor 54*b* becomes "HIGH" when the rotation angle of the throttle grip 36 falls within the range from about −1 degree to about +14 degrees.

Thus, as shown by elements (c) and (d) in FIG. 7, both outputs of the first stop mode sensor 54*a* and the second stop mode sensor 54*b* become "HIGH" when the rotating angle of the throttle grip 36 is in the vicinity of the neutral position (in this case, in the range from about −1 degree to about +1 degree).

Also, as can be seen in FIG. 7 elements (c) and (d), the range where at least one of the outputs from the first stop mode sensor 54*a* and the second stop mode sensor 54*b* becomes "HIGH", is set to be a little narrower than the entire stop mode range. Such an arrangement allows a highly precise detection in that the throttle grip 36 designates the stop mode when at least one of the outputs from the first stop mode sensor 54*a* and the second stop mode sensor 54*b* is at "HIGH".

The duration of the "HIGH" output and the timing of its occurrence for the first stop mode sensor 54*a* are determined by the positioning of the first stop mode sensor 54*a*, the length of the cutout 50*a*, and so on. Similarly, the duration of the "HIGH" output and the timing of its occurrence for the second stop mode sensor 54*b* are determined by the positioning of the second stop mode sensor 54*b*, the length of the slot 50*b*, and so on.

The CPU 88 controls the electric motor 16 taking account of not only the output of the potentiometer 46, but also the outputs of the first stop mode sensor 54*a* and the second stop mode sensor 54*b*. Thus, even when the potentiometer 46 has some detecting error, the CPU 88 can identify the stop mode designated by the throttle grip 36 with a high accuracy, by taking account of the outputs of the first stop mode sensor 54*a* and the second stop mode sensor 54*b*.

As shown by element (e) in FIG. 7, motor current that flows through the electric motor 16 is controlled by the output of the potentiometer 46 when the output (voltage signal) within a specified range is fed to the CPU 88 from the potentiometer 46. In other words, the operation mode of the electric motor 16 is controlled by the CPU 88 based on the position designated by the throttle grip 36. When the stop mode is designated by the throttle grip 36, the motor current becomes zero and the electric motor 16 comes to a stop.

The reverse lock is locked when the throttle grip 36 is rotated by approximately 10 degrees clockwise from the neutral position, as shown by element (f) in FIG. 7. In other words, as the throttle grip 36 is rotated by approximately 10 degrees clockwise from the neutral position, the collar 64 is positioned in the slot 52*b* on the cam plate 48, the pushing section 66 rises accordingly, and the end portion of the arm portion 80 is lowered to be engaged and locked with the receiving bar 84. Thus, the reverse lock is in place.

In this preferred embodiment, a designation device preferably includes the throttle grip 36. A first detection device preferably includes the potentiometer 46. A second detection device preferably includes the first stop mode sensor 54*a* defining a first sensor, the second stop mode sensor 54*b* defining a second sensor, and the CPU 88. A determination device preferably includes the CPU 88 and the disconnection and short detecting circuit 92. The CPU 88 also serves as a controller.

Next, an operation of the boat propulsion unit 10 will be exemplified referring to FIG. 8.

First, the CPU 88 checks if the voltage signal fed to it by the disconnection and short detecting circuit 92 falls within the specified range (in this case, preferably from about 1.3V to about 3.7V) of the voltage signal from the potentiometer 46, and determines if the position designated by the throttle grip 36 is undetectable or not (Step S1). If any disconnection or short-circuiting has occurred on the potentiometer 46, and the voltage signal fed to the CPU 88 by the disconnection and short detecting circuit 92 is either approximately 0V or 5V, the CPU 88 determines that the position designated by the throttle grip 36 is undetectable.

If the CPU 88 determines that the position designated by the throttle grip 36 is undetectable in Step S1, the CPU 88 makes the motor driver 98 shut off the motor current (to zero) regardless of the motor current being supplied at the time. The CPU 88 also activates the warning buzzer 102 (Step S3). In other words, when the position designated by the throttle grip 36 cannot be detected by the potentiometer 46, the electric motor 16 is forced to stop, and the occurrence of an abnormal condition is notified to the boat operator by the warning sound from the warning buzzer 102.

Subsequently, the system is placed in a stand-by condition until the outputs of both the first stop mode sensor 54*a* and the second stop mode sensor 54*b* become "HIGH" level (Step S5). In other words, the system is temporarily placed in a stand-by condition until the position designated by the throttle grip 36 returns to the area in the vicinity of the neutral position (see FIG. 7 elements (a), (c), and (d)).

If the output of the first stop mode sensor 54*a* and the output of the second stop mode sensor 54*b* become "HIGH" in Step S5, the system is placed in stand-by condition until the outputs of both the first stop mode sensor 54*a* and the second stop mode sensor 54*b* become "LOW" (Step S7). When both of the outputs become "LOW" in Step S7, the CPU 88 first checks the second stop mode sensor 54*b*, and then checks the first stop mode sensor 54*a* to determine which of the second stop mode sensor 54*b* and the first stop mode sensor 54*a* became the "LOW" level first (Step S9).

Figure 9A:
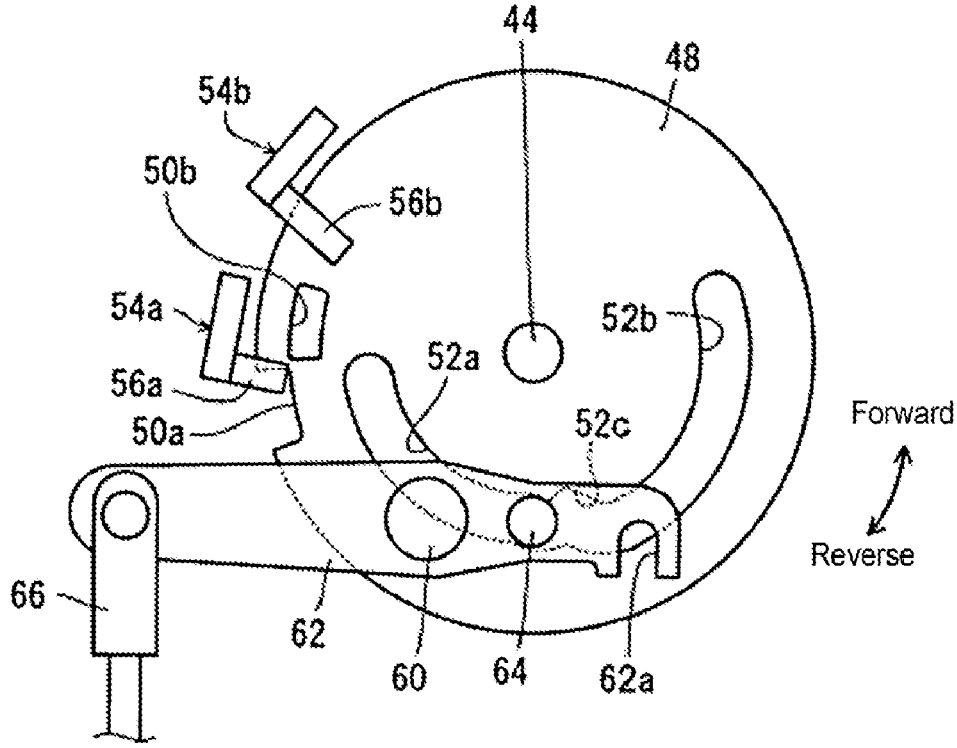
FIGS. 9A and 9B are illustrations showing the relative position of the cam plate, the first stop mode sensor, and the second stop mode sensors.
Figure 9B:
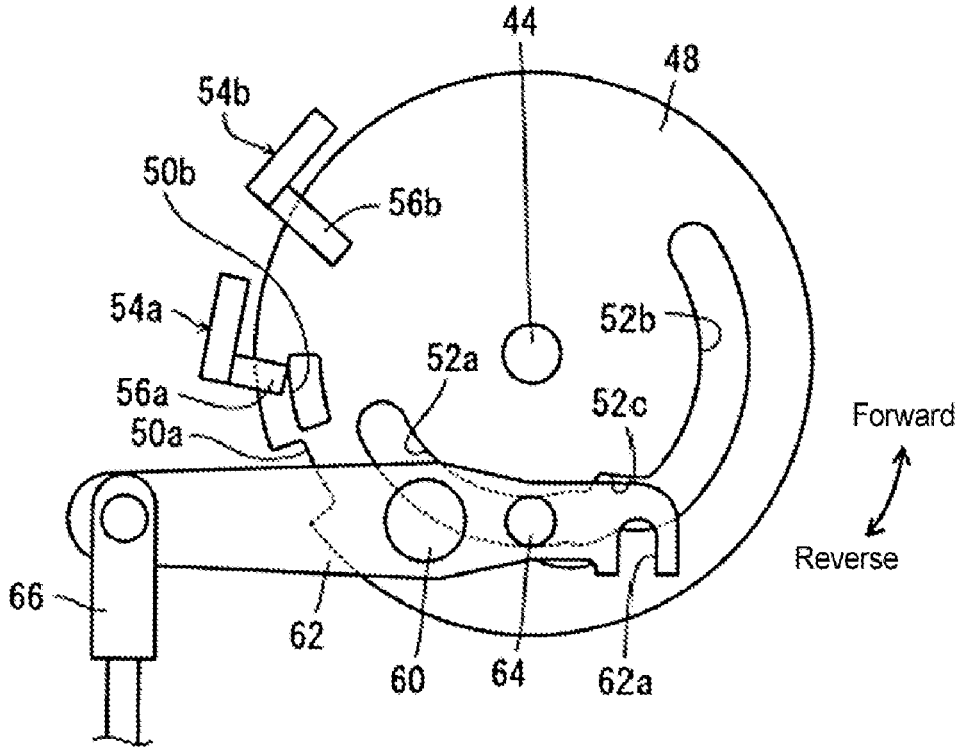

When the throttle grip 36 positioned in the vicinity of the neutral position is rotated toward the forward operation mode range (counterclockwise), the cam plate 48 rotates from the position shown in FIG. 5. Initially, as shown in FIG. 9A, the slot 50*b* is displaced from the light emitting portion 56*b* and the light receiving portion 58*b* of the second stop mode sensor 54*b*. The output of the second stop mode sensor 54*b* becomes "LOW" during this action. As the throttle grip 36 is rotated further toward the forward operation mode range, the cutout 50*a* is displaced from the light emitting portion 56*a* and the light receiving portion 58*a* of the first stop mode sensor 54*a* as shown in FIG. 9B, and the output of the first stop mode sensor 54*a* also becomes "LOW". Accordingly, if the output is verified to be "LOW" for the second stop mode sensor 54*b* first, and then for the first stop mode sensor 54*a*, it can be identified that the throttle grip 36 is rotated from the stop mode range into the forward operation mode range, and the forward operation mode is designated by the throttle grip 36.

Figure 10A:
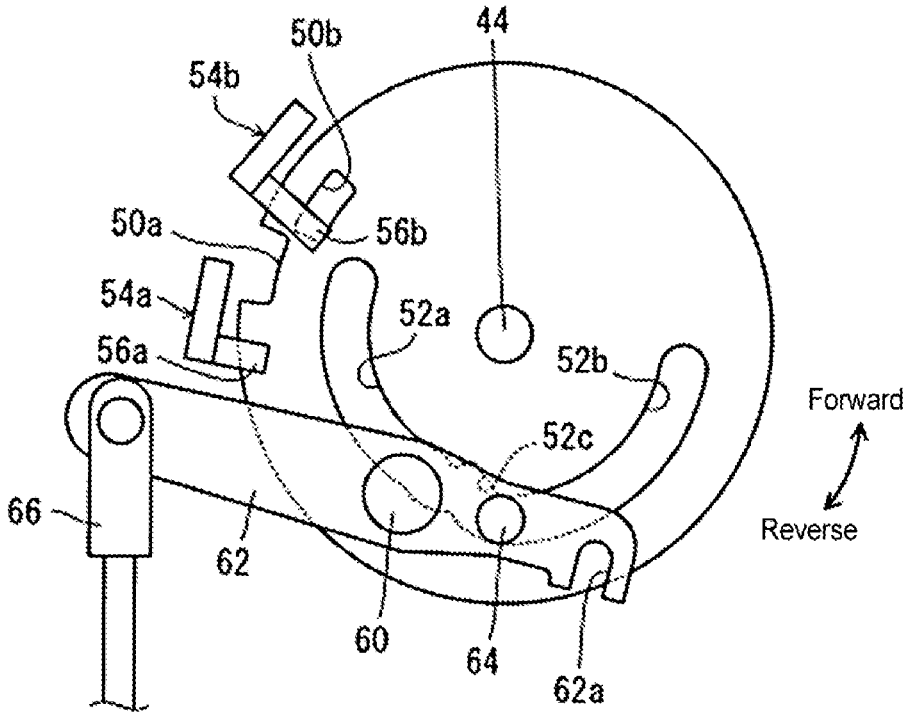
FIGS. 10A and 10B are illustrations showing the relative position of the cam plate, the first stop mode sensor, and the second stop mode sensors.
Figure 10B:
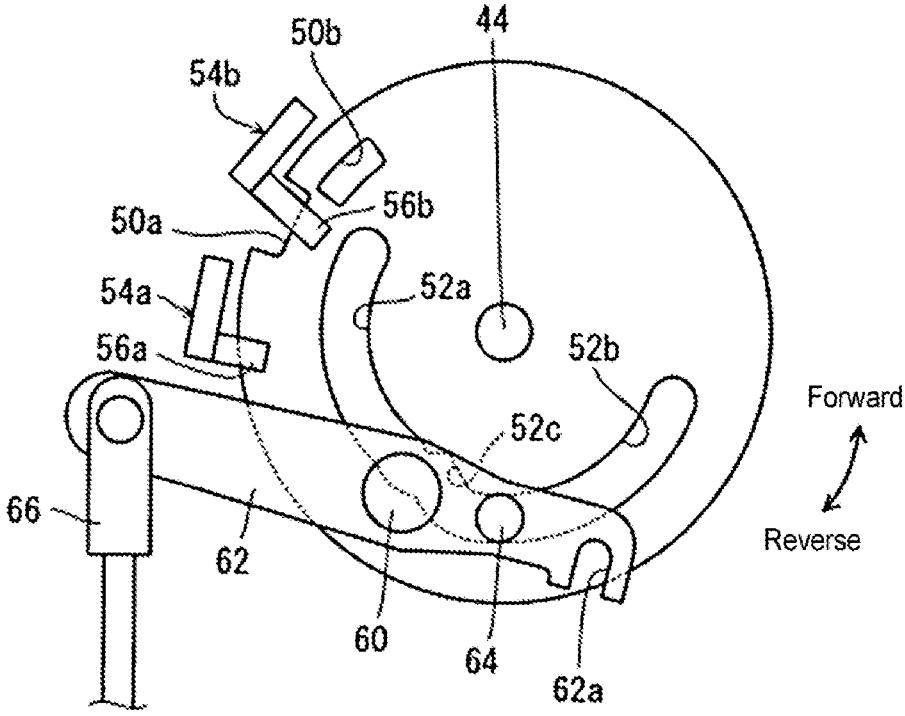

On the other hand, when the throttle grip 36 positioned in the vicinity of the neutral position is rotated toward the reverse operation mode range (clockwise), the cam plate 48 rotates from the position shown in FIG. 5. Initially, as shown in FIG. 10A, the cutout 50*a* is displaced from the light emitting portion 56*a* and the light receiving portion 58*a* of the first stop mode sensor 54*a*. The output of the first stop mode sensor 54*a* becomes "LOW" during this action. As the throttle grip 36 is rotated further toward the reverse operation mode range, the slot 50*b* is displaced from the light emitting portion 56*b* and the light receiving portion 58*b* of the second stop mode sensor 54*b* as shown in FIG. 10B, and the output of the second stop mode sensor 54*b* also becomes "LOW". Accordingly, if the output is initially verified to be "LOW" for the first stop mode sensor 54*a*, and then later for the second stop mode sensor 54*b*, it can be identified that the throttle grip 36 has rotated from the stop mode range into the reverse operation mode range, and the reverse operation mode is designated by the throttle grip 36.

When the output is initially verified to be "LOW" for the second stop mode sensor 54*b*, and then later for the first stop mode sensor 54*a* in Step S9, the CPU 88 drives the electric motor 16 in the forward operation mode and with specified current value (at about 25% of the maximum current value, for instance, as shown in FIG. 7 element (e) by a chain double-dashed line). In other words, if it is detected that the forward operation mode is designated by the throttle grip 36 based on the changes in the outputs of the first stop mode sensor 54*a* and the second stop mode sensor 54*b*, the electric motor 16 is driven in the forward operation mode and with the specified output power (Step S11).

Subsequently, the system is placed in a stand-by condition until the output of the first stop mode sensor 54*a* becomes "HIGH" (Step S13). In other words, the system is placed in a stand-by condition until the stop mode is designated by the throttle grip 36. Once the output of the first stop mode sensor 54*a* becomes "HIGH", the electric motor 16 is stopped (Step S15), and the system goes back to Step S1.

Alternatively, when the output is not verified to be "LOW" by first checking the second stop mode sensor 54*b* and then checking first stop mode sensor 54*a* in Step S9, it indicates that the output has moved from an initially "LOW" level at the first stop mode sensor 54*a*, and then at the second stop mode sensor 54*b*. In this case, the CPU 88 drives the electric motor 16 in the reverse operation mode and with a specified current value (at about 25% of the maximum current value, for instance, as shown in FIG. 7 element (e) by a chain double-dashed line). In other words, if it is detected that the reverse operation mode is designated by the throttle grip 36, the electric motor 16 is driven in the reverse operation mode and with the specified output power (Step S17).

Subsequently, the system is placed in a stand-by condition until the output of the second stop mode sensor 54*b* becomes "HIGH" (Step S19). When the output of the second stop mode sensor 54*b* becomes "HIGH", the system goes to Step S15.

Alternatively, when the voltage signals fed to the CPU 88 from the potentiometer 46 fall within the specified range in Step S1, the CPU 88 controls the electric motor 16 using each output of the potentiometer 46, the first stop mode sensor 54*a*, and the second stop mode sensor 54*b* as described above. In other words, the CPU 88 controls the electric motor 16 in the normal way according to the position designated by the throttle grip 36, and at the same time takes account of the outputs of the first stop mode sensor 54*a* and the second stop mode sensor 54*b* (Step S21). Determination in Step S1 is carried out repeatedly while the system is in Step S21.

In the operation described above, the warning buzzer 102 is activated continuously after a disconnection or short-circuiting has occurred in the potentiometer 46, however, the warning buzzer 102 may be deactivated after a certain period of time.

According to the boat propulsion unit 10 described above, the changes in the outputs of the first stop mode sensor 54*a* and the second stop mode sensor 54*b* can be used to detect whether the forward operation mode or the reverse operation mode is designated by the throttle grip 36. When it is detected that the forward operation mode is designated, the electric motor 16 is driven in the forward operation mode and with the specified output power, whereas, when it is detected that the reverse operation mode is designated, the electric motor 16 is driven in the reverse operation mode and with the specified output power. In this way, the minimum required boat operation can be obtained as intended by the boat operator, even when an abnormality such as disconnection or short-circuiting has occurred on the potentiometer 46.

The operation mode designated by the throttle grip 36 can be detected easily by using the first stop mode sensor 54*a* and the second stop mode sensor 54*b*.

After the disconnection or short-circuiting has occurred on the potentiometer 46, the electric motor 16 will not be driven until the position designated by the throttle grip 36 once returns to the vicinity of the neutral position (within the range from about −1 degree to about +1 degree), regardless of the rotation of the throttle grip 36 into the forward operation mode range or into the reverse operation mode range. In this way, additional operating steps are required in comparison with those under the normal condition after the occurrence of the wire disconnection or short-circuiting. This will result in a more careful operation when the boat operator rotates the throttle grip 36. Also, after the occurrence of the disconnection or short-circuiting, the rotational operation for driving the electric motor 16 is deliberately made more complicated than the normal operation. This will call the boat operator's attention to the need of repair, and prompt him or her to take the necessary action.

Note that the rotation range of the throttle grip 36 is not limited to the one described in the preferred embodiments above, but it can be set up arbitrarily. Also, the proportion of the forward operation mode range, the reverse operation mode range, and the stop mode range within the rotation range of the throttle grip 36 can also be set up arbitrarily. Further, in the preferred embodiments described above, the forward operation mode range is reached by turning the throttle grip 36 counterclockwise from the stop mode range, and the reverse operation mode range is reached by turning it clockwise. However, this may be inverted so that the forward operation mode range is reached by turning the throttle grip 36 clockwise from the stop mode range, and the reverse operation mode range is reached by turning it counterclockwise.

Additionally, the range of voltage signals fed to the CPU 88 by the potentiometer 46, and the value of voltage signal fed to the CPU 88 by the disconnection and short detecting circuit 92 in case of the occurrence of the disconnection or short-circuiting of the potentiometer are not limited to those described in the preferred embodiments above, but they can be set up arbitrarily.

Likewise, FIG. 7 element (b) shows the case where the output of the potentiometer 46 becomes gradually smaller from the forward operation mode range toward the reverse operation mode range. However, it can be arranged so that the output of the potentiometer 46 becomes gradually larger from the forward operation mode range toward the reverse operation mode range.

The switching behaviors of the output from the first stop mode sensor 54*a* and the second stop mode sensor 54*b* relative to the rotation of the throttle grip 36 are not limited to those described in the preferred embodiments above. The switching behaviors shown in FIG. 7 elements (c) and (d) can be replaced with other switching behaviors shown in FIG. 11 elements (b) and (c), or FIG. elements 12 (*b*) and (*c*), for instance.

Figure 11:
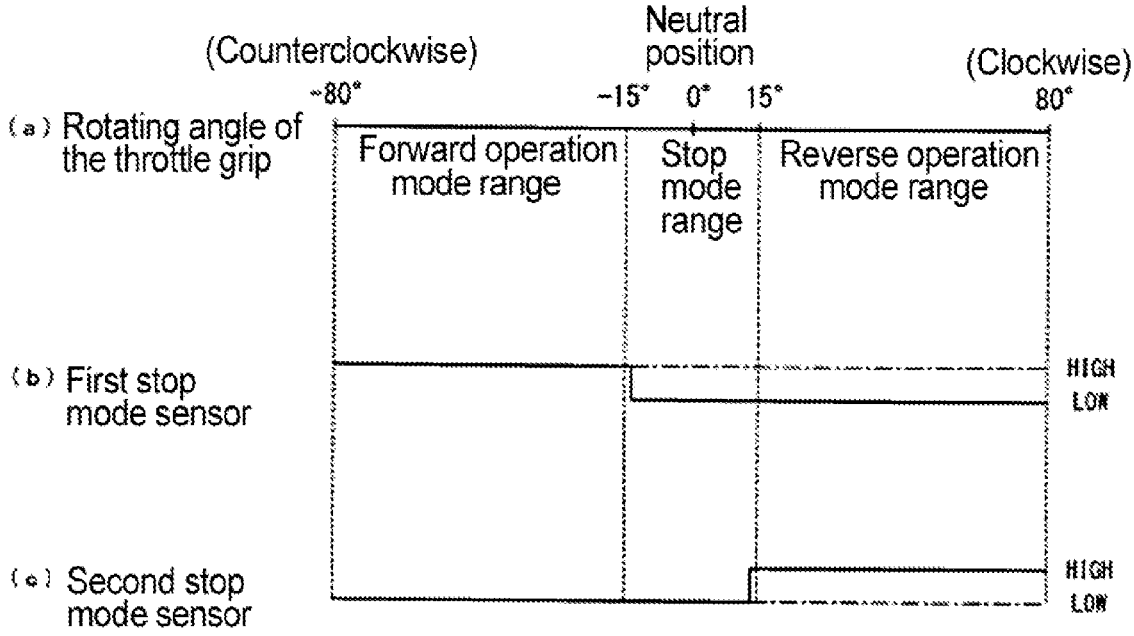
FIG. 11 is a graph showing another example of the stop mode sensor output in relation to the rotation of the throttle grip.

In the case of FIG. 11, the output of the first stop mode sensor 54*a* becomes "HIGH" from a point a little closer to the neutral position relative to the boundary of the forward operation mode range and the stop mode range, over the entire forward operation mode range (see FIG. 11 element (b)), and the output of the second stop mode sensor 54*b* becomes "HIGH" from the point a little closer to the neutral position relative to the boundary of the reverse operation mode range and the stop mode range, over the entire reverse operation mode range (see FIG. 11 element (c)). In this case, the stop mode is identified when both outputs of the first stop mode sensor 54*a* and the second stop mode sensor 54*b* are "LOW", the forward operation mode is identified when the output of the first stop mode sensor 54*a* is "HIGH", and the reverse operation mode is identified when the output of the second stop mode sensor 54*b* is "HIGH", thus these modes can be identified easily. Consequently, the current position can be detected easily whether it is in the forward operation mode, the reverse operation mode, or in the stop mode.

Figure 12:
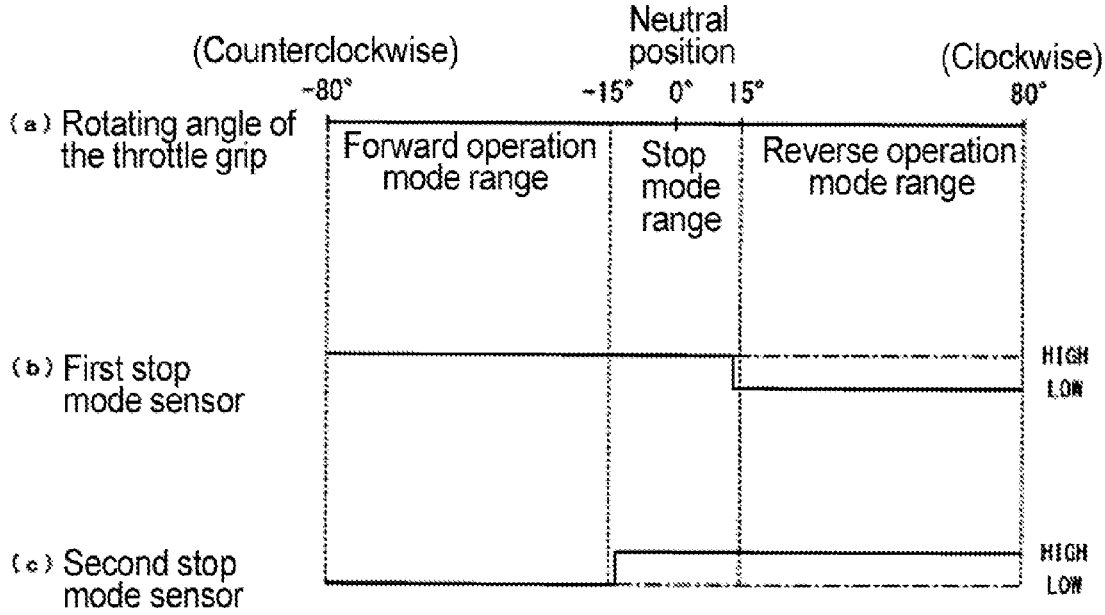
FIG. 12 is a graph showing still another example of the stop mode sensor output in relation to the rotation of the throttle grip.

In the case of FIG. 12, the output of the first stop mode sensor 54*a* becomes "HIGH" over the entire forward operation mode range, and in most portions of the stop mode range (see FIG. 12 element (b)), and the output of the second stop mode sensor 54*b* becomes "HIGH" over the entire reverse operation mode range and in most portions of the stop mode range (see FIG. 12 element (c)). In this case, the stop mode is identified when both outputs of the first stop mode sensor 54*a* and the second stop mode sensor 54*b* are "HIGH", the reverse operation mode is identified when the output of the first stop mode sensor 54*a* is "LOW", and the forward operation mode is identified when the output of the second stop mode sensor 54*b* is "LOW". Thus, the modes can be identified easily. Consequently, the current position can be detected easily whether it is in the forward operation mode, the reverse operation mode, or in the stop mode.

A DC (direct current) motor is preferably used as an electric motor 16 in the preferred embodiments described above, however, an AC (alternating current) motor could also be used as the electric motor. In this case, the direct-current power from the battery 30 can be converted into the alternating-current power using a DC/AC inverter.

In addition, the potentiometer 46 may be replaced with an optical position sensor or a magnetic sensor.

Likewise, the first stop mode sensor 54*a* and the second stop mode sensor 54*b* can be replaced with a potentiometer or an absolute-value encoder.

Also, in the preferred embodiments described above, not only the output of the potentiometer 46, but also the outputs of the first stop mode sensor 54*a* and the second stop mode sensor 54*b* are taken into account when the electric motor 16 is controlled, even when the position of the throttle grip 36 can be detected by the potentiometer 46. However, the present invention is not limited to such an arrangement. The electric motor 16 may be controlled based on the output of the potentiometer 46 alone, when the position of the throttle grip 36 can be detected by the potentiometer 46.

Also in the preferred embodiments described above, the warning buzzer 102 is used as a notification. However, the display section 100 may be used as a notification.

Further, the output of the electric motor 16 in case of the occurrence of the wire disconnection or short-circuiting of the potentiometer 46 can be controlled arbitrarily. It may be controlled, for instance, to increase the output of the electric motor 16 as the forward operation mode or reverse operation mode have been designated for a longer period of time.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

an electric motor;

a designation device arranged to rotate and designate by its rotation position an operating mode of the electric motor including a forward mode, a reverse mode, and a stop mode, and also designate an output power of the electric motor;

a first detecting device arranged to detect the rotation position of the designation device;

a second detecting device arranged to detect the operation mode of the electric motor designated by the designation device based on the rotation position of the designation device;

a determination device arranged to determine whether or not the first detecting device can detect the position designated by the designation device; and a controller arranged to control the operating mode and the output power of the electric motor based on the determination obtained by the determination device and detection results obtained by at least one of the first detection device and the second detection device.

2. The boat propulsion unit according to claim 1, wherein a rotation range of the designation device includes a forward operation mode range designating the forward operation mode, a reverse operation mode range designating the reverse operation mode, and a stop mode range between the forward operation mode range and the reverse operation mode range designating the stop mode;

and the second detection device includes a first sensor arranged to detect the rotation of the designation device from either of the forward operation mode range and the stop mode range into the other mode range, and a second sensor arranged to detect the rotation of the designation device from either of the reverse operation mode range and the stop mode range into the other mode range.

3. The boat propulsion unit according to claim 1, wherein the designation device includes a cam plate having a first slot and a second slot, and the first sensor is arranged to detect the first slot and the second sensor is arranged to detect the second slot.

4. The boat propulsion unit according to claim 1, wherein the first detecting device is a potentiometer.

5. The boat propulsion unit according to claim 1, wherein the determination device includes a circuit arranged to detect whether or not the potentiometer is disconnected or short-circuited.

* * * * *